United States Patent [19]

Taylor et al.

[11] Patent Number: 5,035,434

[45] Date of Patent: Jul. 30, 1991

[54] LACROSSE STICK HEAD WITH BULGED SIDE WALLS

[75] Inventors: Joseph Taylor, Manlius, N.Y.; William H. Brine, III, Mendon, Mass.; Peter J. Brine, Hanover, N.H.

[73] Assignee: Sports Licensing, Inc., Hanover, N.H.

[21] Appl. No.: 628,193

[22] Filed: Dec. 14, 1990

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| D. 236,737 | 9/1975 | Brine | D34/5 CB |
| D. 263,248 | 3/1982 | Brine, Jr. | D21/210 |
| D. 286,666 | 11/1986 | Brine, Jr. | D21/210 |
| 2,142,527 | 1/1939 | Pool | 273/326 |
| 4,049,273 | 9/1977 | Pool | 273/326 |
| 4,153,251 | 5/1979 | Pond | 273/326 |
| 4,657,260 | 4/1987 | Brine, Jr. | 273/326 |

*Primary Examiner*—William H. Grieb

*Attorney, Agent, or Firm*—Lorusso & Loud

[57] ABSTRACT

A lacrosse stick head in which the frame and netting are so configured as to provide a ball pocket spaced from the throat portion of the head. The side walls of the frame have a bottom edge extending outwardly to define a bulge in the bottom of the side walls about midway of the length of the side walls. The ball pocket of the netting is disposed generally alongside and beneath the bulge and generally midway between the side walls.

9 Claims, 3 Drawing Sheets

LACROSSE STICK HEAD WITH BULGED SIDE WALLS

BACKGROUND OF THE INVENTION

1. Field of the Invention

This invention relates to lacrosse sticks and is directed more particularly to a lacrosse stick head having a pocket spaced from the throat portion of the head.

2. Description of the Prior Art

Lacrosse sticks generally are well known in the art and typically comprise a head frame including a throat portion, at which a stick handle is affixed to the head, and side wall means extending from the throat portion and joined to a lip portion. Netting is supported by the frame and defines a ball pocket, traditionally located in the throat area of the frame.

A player, in the course of play, normally carries the stick such that a ball carried in the head portion of the stick rests in the ball pocket in the throat area. The throat area is relatively narrow compared to the remainder of the head and relatively securely retains the ball.

In passing the ball from player to player, or in directing the ball toward a goal, players traditionally have tended to take a full swing of the stick, causing the ball to roll out of the throat pocket, over the length of the netting, over the lip portion of the frame and into flight. In more recent times, however, as the game has progressed, passing and shooting for goal often have become wrist-flicking exercises, rather than full swing maneuvers. The player who exercises the quicker wrist-flicking approach to launching the ball can realize difficulties with accuracy because of early departure of the ball from the head. The motion and quickness of the motion often cause the ball to fly out of the head without passing over the lip portion of the head, leading to errant flight of the ball which, of course, is undesirable in the course of play.

Accordingly, it is deemed beneficial by the lacrosse community to have a lacrosse stick provided with a ball pocket spaced from the throat portion of the head and nearer the lip portion.

SUMMARY OF THE INVENTION

It is, therefore, an object of the invention to provide a lacrosse stick head in which the frame and netting are so configured as to provide a ball pocket spaced from the throat portion of the head.

With the above and other objects in view, as will hereinafter appear, a feature of the present invention is the provision of a lacrosse stick head comprising a frame and netting attached to the frame, the frame comprising side wall means extending from a throat portion of the frame, the side wall means having a bottom edge thereof extending outwardly such as to generally define a bulge in the bottom of the side wall means generally about midway of the length of the side wall means, the side wall means having holes therein proximate the bottom edge, the netting being attached to the side wall means by portions of the netting disposed in the side wall means holes, the netting defining a ball pocket disposed generally alongside and beneath the bulge and generally midway sidewise of the netting, whereby there is provided a lacrosse stick head having a ball pocket spaced from the throat portion of the frame and the side wall means.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
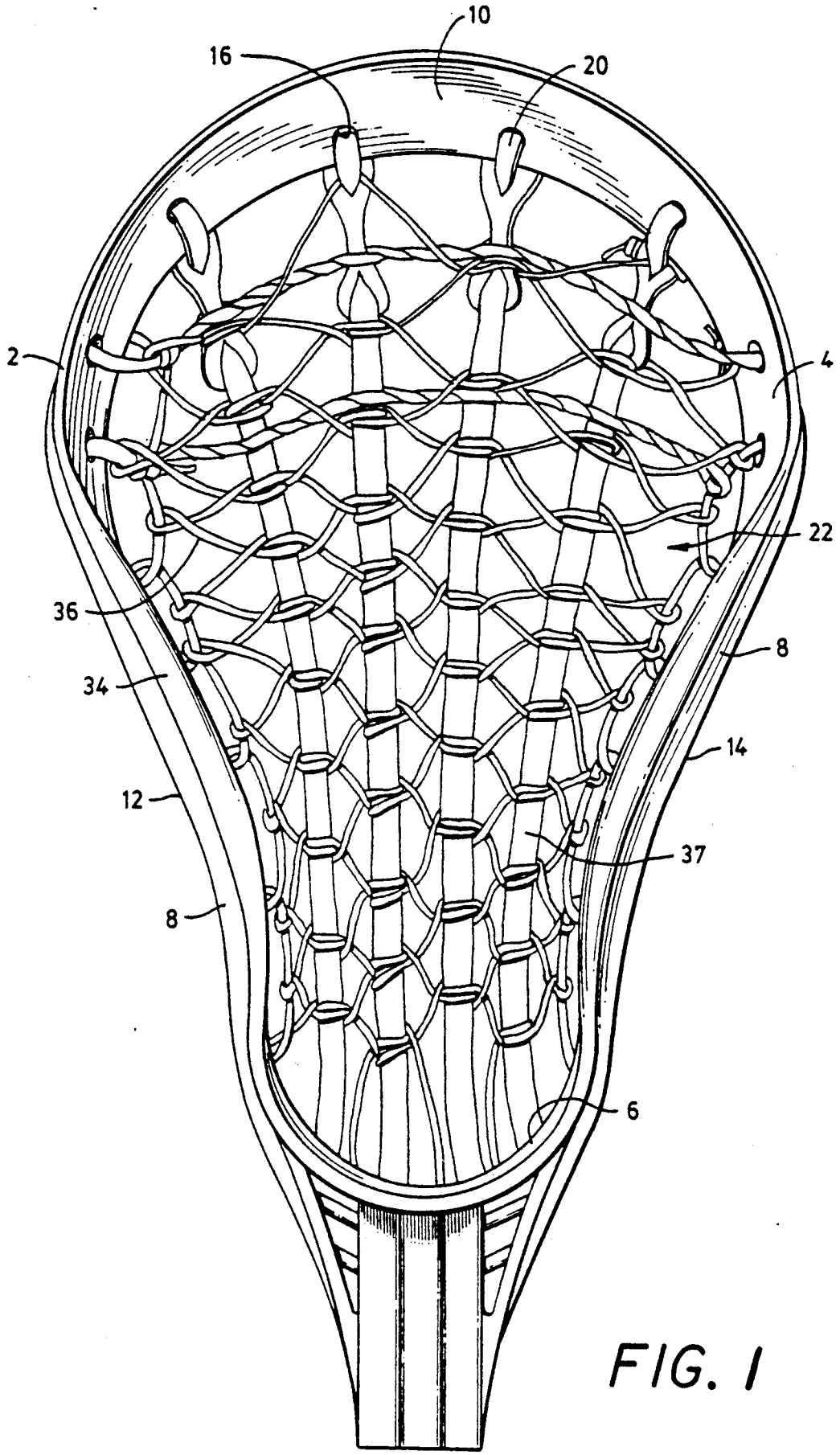
FIG. 1 is a top plan view of one form of lacrosse stick head illustrative of an embodiment of the invention.

Referring to the drawings, it will be seen that an illustrative lacrosse stick includes a head portion 2 adapted to be connected to a stick handle (not shown). The head portion 2 comprises a frame 4 which includes a throat portion 6 from which extend side wall means 8. A distal end of the side wall means 8 joins a lip portion 10. The side wall means 8 generally include two side walls 12, 14, as illustrated in FIG. 1, but may comprise only one side wall. The frame 4 may be of wood, but in recent times has generally been constructed of a substantially rigid light-weight plastic, such as a nylon, a polyurethane, or mixtures of thermoplastic polymers.

The throat portion 6, the side wall means 8 and the lip portion 10 are provided with holes 16 in which are disposed portions 18, 20, respectively, of a netting 22. The netting 22 is thus attached to and retained by the frame 4.

Figure 4:
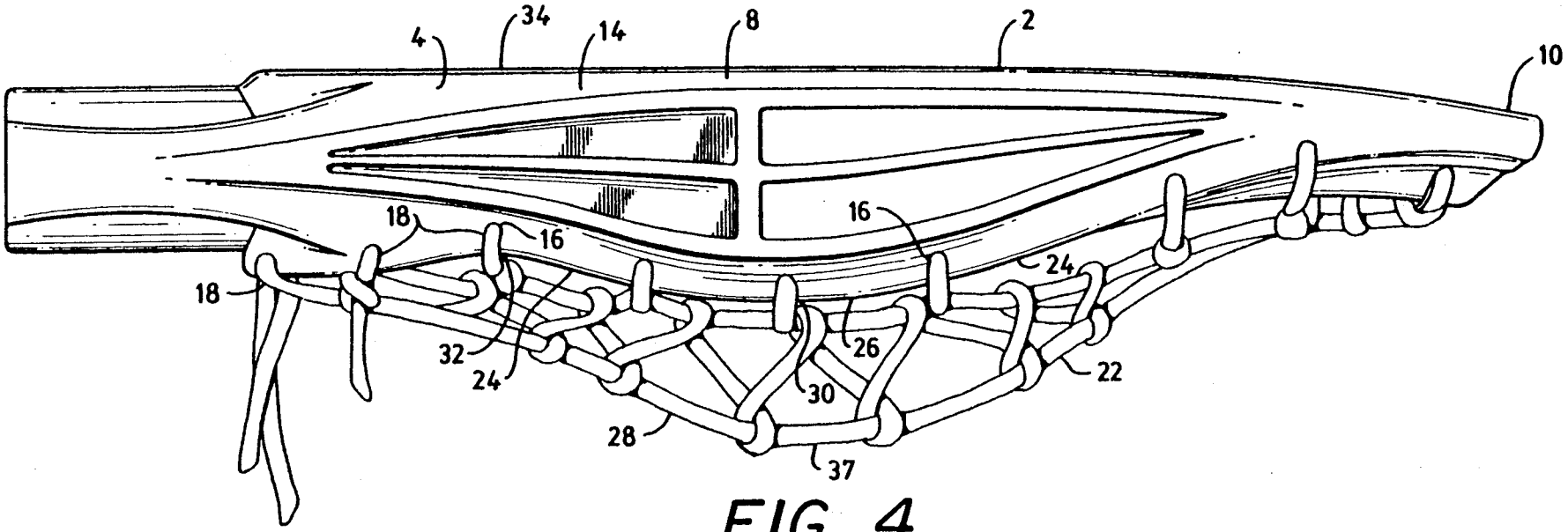
FIG. 4 is a side elevational view of the lacrosse stick head shown in FIGS. 1 and 2.

Referring to FIG. 4, it will be seen that the side wall means 8 is characterized by a bottom edge thereof 24 which extends outwardly, edgewise, such as generally to define a bulge 26 in the bottom of the side wall means. The bulge 26 comprises an outward extension of the bottom edge 24, the bulge being substantially in the plane of the side wall. The holes 16 in the side wall means 8 are each disposed proximate the bottom edge 24, enabling the netting to define a ball pocket 28 generally alongside and beneath the bulge 26, which is disposed about mid-length of the side wall means.

Figure 2:
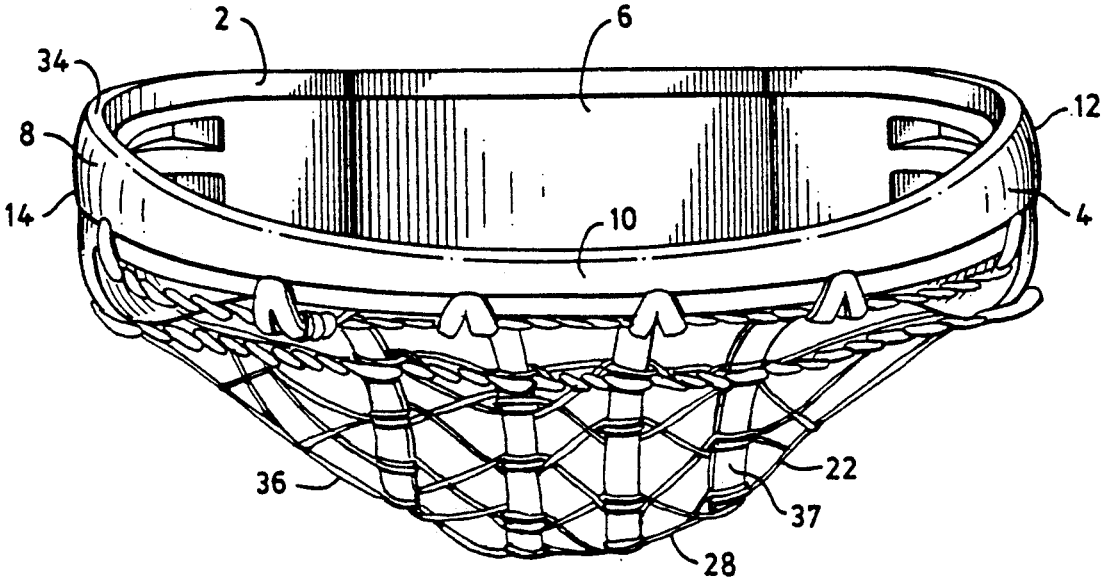
FIG. 2 is a front elevational view of the lacrosse stick head shown in FIG. 1.
Figure 3:
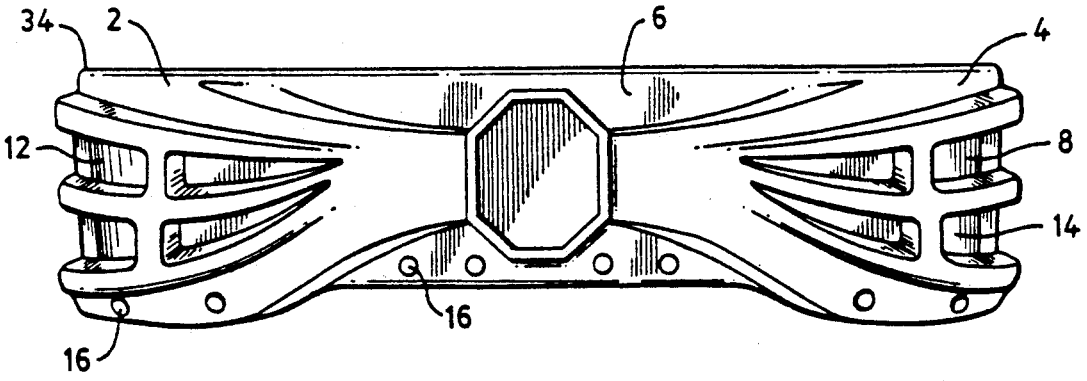
FIG. 3 is a rear elevational view of the lacrosse stick head shown in FIGS. 1 and 2, less the netting portion.

The bulge 26 at its midpoint 30 (FIG. 2) is about 1.15–1.5 times the height of the side wall means at the throat end 32 of the bulge. The netting 22 is arranged such as to allow the ball pocket to extend about 3.5–3.8 inches beneath a top edge 34 of the side wall means. Widthwise strands 36 and lengthwise strands 37 of the netting 22 are configured so as to define the ball pocket 28 widthwise of the head 2 in a substantially centered location (FIG. 2).

Thus, there is provided a lacrosse stick head having a ball pocket spaced from the throat area of the head and closer to the lip portion, but also spaced from the lip portion, as well as the side wall means.

It is to be understood that the present invention is by no means limited to the particular construction herein disclosed and/or shown in the drawings, but also comprises any modifications or equivalents within the scope of the claims.

Having thus described our invention, what we claim as new and desire to secure by Letters Patent of the United States is:

1. A lacrosse stick head comprising a frame and netting attached to said frame, said frame comprising side wall means extending from a throat portion of said frame, said side wall means having a bottom edge thereof extending outwardly such as generally to define a bulge in the bottom of said side wall means generally about midway of the length of said side wall means, said side wall means having holes therein proximate said bottom edge, said netting being attached to said wall means by portions of said netting disposed in said side wall means holes, said netting defining a ball pocket disposed generally alongside and beneath said bulge and generally midway sidewise of said netting, whereby to provide a lacrosse stick head having a ball pocket spaced from said throat portion of said frame and said side wall means.

2. The lacrosse stick head in accordance with claim 1 wherein said side wall means is joined to a lip portion of said frame, said lip portion being provided with holes therein, and said netting being further attached to said frame by other portions of said netting disposed in said lip portion holes, said ball pocket being spaced from said lip portion.

3. The lacrosse stick head in accordance with claim 2 wherein said side wall means comprise first and second side walls, each joined at one end to said throat portion and at another end to said lip portion of said head.

4. The lacrosse stick head in accordance with claim 1 wherein the height of said side wall means at a midpoint of said bulge is about 1.2–1.5 times the height of said side wall means at the throat end of said bulge.

5. The lacrosse stick head in accordance with claim 3 wherein the height of each of said side walls at a midpoint of said bulge is about 1.15–1.5 times the height of said side wall at the throat end of said bulge.

6. The lacrosse stick head in accordance with claim 4 wherein said side wall means is joined to a lip portion of said frame, said lip portion being provided with holes therein, and said netting being further attached to said frame by other portions of said netting disposed in said lip portion holes, said ball pocket being spaced from said lip portion.

7. The lacrosse stick head in accordance with claim 6 wherein said side wall means comprises first and second side walls, each joined at one end to said throat portion and at another end to said lip portion of said head.

8. The lacrosse stick head in accordance with claim 1 in which said bulge comprises an outward extension of said bottom edge substantially in the plane of said side wall means.

9. A lacrosse stick head comprising a frame and netting attached to said frame, said frame comprising first and second side walls extending divergently from a throat portion of said frame and joining a lip portion, each of said side walls having a bottom edge thereof extending outwardly such as generally to define a bulge in the bottom of the side wall, said bulge being disposed generally about midway of the length of the side wall, said netting being attached to said side walls at locations proximate said bottom edges of said side walls, said netting defining a ball pocket disposed generally alongside and beneath said bulges, generally midway sidewise of said netting, and forwardly of said throat portion.

* * * * *